US005880701A

United States Patent [19]

Bhame et al.

[11] Patent Number: 5,880,701

[45] Date of Patent: Mar. 9, 1999

[54] ENCLOSED WIRELESS TELECOMMUNICATIONS ANTENNA

[75] Inventors: William H. Bhame, Marietta; Bassem Rustom, Lilburn; Robert L. Dick, IV, Atlanta, all of Ga.

[73] Assignee: PCS Solutions, LLC, Atlanta, Ga.

[21] Appl. No.: 670,410

[22] Filed: Jun. 25, 1996

[51] Int. Cl.[6] ..... H01Q 1/12

[52] U.S. Cl. ..... 343/890; 343/765; 343/891; 343/892

[58] Field of Search ..... 343/765, 763, 343/766, 890, 891, 892, 893

[56] References Cited

U.S. PATENT DOCUMENTS

| | | | |
|---|---|---|---|
| 2,618,746 | 11/1952 | Pauch | 343/890 |
| 3,028,595 | 4/1962 | Cole et al. | 343/765 |
| 3,303,506 | 2/1967 | Diebold | 343/890 |
| 3,999,184 | 12/1976 | Fuss | 343/765 |
| 4,284,061 | 8/1981 | Wildenrotter | 343/765 |
| 4,301,457 | 11/1981 | Bogner | 343/891 |
| 4,535,961 | 8/1985 | Sobczak et al. | 343/765 |
| 5,533,304 | 7/1996 | Noble | 343/890 |
| 5,537,124 | 7/1996 | Rankin et al. | 343/765 |

OTHER PUBLICATIONS

PHAZAR 50°, 80°, 90°, and 105° Planar Antennas, Hazeltine Corporation,© 1995.

DB976H120(E) 120° 11.5 dBd Directional Antenna, Decimal Products, dated Oct. 1995.

*Primary Examiner*—Donald T. Hajec
*Assistant Examiner*—Tho Phan
*Attorney, Agent, or Firm*—Polster, Lieder, Woodruff & Lucchesi, LC

[57] ABSTRACT

The present invention relates to an antenna module for installation on a wireless telecommunications tower at a transceiver site. The antenna module comprises a frame adapted to be installed on the upper end of the tower, containing a means for mounting, and adjusting the alignment of, one or more panel antennas for optimal signal transmission and reception. A radio frequency energy transparent cover surrounds the antenna module, extending height-wise of the frame, enclosing it, the mounting means, and the panel antennas mounted thereon, thereby reducing wind loading on the antenna module.

22 Claims, 5 Drawing Sheets

ENCLOSED WIRELESS TELECOMMUNICATIONS ANTENNA

BACKGROUND OF THE INVENTION

This invention relates to a system for allowing several different wireless telecommunications service providers to co-locate multiple dual polarization antenna panels on a common monopole or lattice-type tower, reducing the number of such towers needed to service a given market area. More particularly, the system allows for each service provider to independently adjust their respective antenna panels for optimal signal transmission and reception without interfering with the antenna panels of the other co-located service providers. The antenna panels are arranged in a small-footprint stackable configuration, designed to minimizing back lobe emissions and improving the overall visual appearance of the tower or pole.

With the recent growth of wireless cellular communication systems, many telecommunications service providers are constructing proprietary networks of cellular antenna sites spaced optimally over their service areas so as to provide continuous coverage for their subscribers. Each of these sites typically includes a monopole or lattice-type tower rising up to 175 feet above ground level, enclosures and equipment boxes housing radio, telephone and power connections, and perimeter security fencing. A Typical prior art transceiver antenna tower is shown generally in FIG. 1.

Optimal spacing of transceiver sites is dependent upon several factors including the type of service provided, nearby geographic features which may block signals (hills, tall buildings, etc.), the type of equipment used, and the amount of communications traffic handled by the site. Of course with proprietary systems, if two or more wireless service providers compete in the same market area, each requires their own network of transceiver sites, generally doubling the number of towers required to optimally service the area.

With the advent of personal communication systems (PCS), there will be a significant increase in the number of transceiver sites located in each market area. The operating frequencies of PCS, between 1850 and 1990 MHz, require two to four transceiver sites to cover the same area currently serviced by a single cellular transceiver site. Additionally, it is expected that each market area will be serviced by two to four times as many PCS providers as it is currently by cellular service providers. Clearly, if each PCS provider establishes a proprietary PCS transceiver network, the number of transceiver sites in a community will increase significantly.

Communities often strongly object to the initial installation or subsequent installation of additional transceiver sites because of the ungainly visual appearance of the current tower and antenna designs. With many conventional cellular transceiver sites, the tower is either a lattice-type tower constructed of steel angles and braces, or in the more recent sites, a monopole tower. The monopole tower designs are currently more favored, as they are easier to erect, and have a less objectionable appearance than the lattice-type towers. However, regardless of the type of tower used, one type of conventional antenna used with such towers may consist of six or more flat panel antennas employing three pairs of panels in a spatial diversity receive configuration. Each spatial diversity receive pair is located on the outer end of horizontally aligned elongated arms such that the antenna panels are mounted or spaced in a triangular array. Three or more transmit antenna panels are then mounted in a more closely packed triangular array adjacent the upper end of the tower and central to the spatial diversity receive array, such as is shown in FIG. 3.

Heretofore, spatial diversity receive antenna technology requires individual antenna panels to be separated by several feet for optimal signal reception, and requires the supporting framework to be fairly large. It is known that this large antenna separation allows undesired radio frequency energy emissions, known as side and back lobe emissions, to propagate out from the sides and rear of each antenna panel. Side and back lobe emissions cause deterioration in the overall performance of the transceiver site by interfering with the desired front lobe emissions of the surrounding antenna panels. Additionally, these large and ungainly horizontal antenna support frames contribute significantly to the perceived unattractiveness of transceiver sites, and are the source of many complaints raised by citizens at community zoning meetings held prior to zoning approval for transceiver sites.

It has been a long-standing objective of cellular and PCS service providers to allay community concerns by enhancing the visual appearance of transceiver sites and reducing the number of sites required to service a given area. A dramatic reduction in the number of transceiver sites can be obtained through co-location, i.e. allowing multiple wireless service providers to locate their antenna equipment on a common tower at a single transceiver site. The actual reduction in the number of transceiver sites realized through co-location is dependent on the number of different service providers' antenna arrays which may be placed on the common tower.

The maximum number of antenna panels which may be placed on any given tower is oftentimes limited by that particular tower's maximum wind loading capability. Wind loading capability is a measure of the structural strength of the tower, and is determined by its size and construction, applicable building codes and regulations, and the type of antenna array the tower was designed to support. Since many cellular and PCS service providers have designed proprietary transceiver sites, their towers were designed to only carry their own antenna arrays. Correspondingly, due to the structural design and wind load features of horizontal antenna frames, the number of such antenna arrays which can be co-located onto the existing towers at each transceiver site is limited.

SUMMARY OF THE INVENTION

Among the several objects and features of the present invention may be noted the provision of an antenna mounting system which eliminates the need for a horizontal supporting framework to be carried by a lattice-type or monopole tower, thus significantly reducing the antenna assembly wind resistance, and correspondingly the wind load on the tower itself;

The provision of such an antenna mounting system in which one or more small-footprint antenna modules are mounted on the upper end of a lattice-type or monopole tower, each antenna module having an outer diameter approximately the same as the outer diameter of the upper end of the supporting lattice-type or monopole tower, such that the antenna modules visually appear as an extension of the tower structure, improving its overall appearance;

The provision of such an antenna mounting system which includes a radio-frequency energy transparent cover surrounding the antenna module so as to minimize the module's wind resistance and to provide an improved visual appearance;

The provision of such an antenna mounting system which permits multiple (usually three) dual polarization antenna panels to be mounted within each antenna module and in which each dual polarization antenna panel may be adjusted for optimum signal transmission and reception through changes in its compass alignment (azimuth) and elevational inclination settings without affecting the performance or settings of the remaining antenna panels;

The provision of such an antenna mounting system in which signal interference due to antenna panel side and back lobe emissions is significantly reduced due to the close proximity placement of dual polarization antenna panels within a small-footprint antenna module in which side and back lobe emissions are reduced and contained by the structural materials of the antenna module;

The provision of such an antenna mounting system in which a further reduction in antenna panel side and back lobe emissions is obtained through the use of one or more layers of radio frequency energy absorbing materials, thus further improving antenna panel performance by reducing or eliminating signal interference caused by antenna panel side and back lobe emissions;

The provision of such an antenna mounting system which allow a new or existing lattice-type or monopole tower, particularly a tower originally designed to carry a horizontal antenna support framework, to carry two or more antenna modules of the present invention without the need for structural modifications, thus allowing two or more service providers to co-locate their antenna panels on new or existing towers and transceiver sites;

The provision of such an antenna mounting system which includes structural integrity in an antenna module sufficient to provide adequate wind load bearing capability, to carry one or more antenna panels, along with the associated equipment and cabling, and to support one or more additional antenna modules with their associated equipment and cables, stacked thereon in a vertical configuration;

The provision of such an antenna mounting systems in which one service provider may adjust antenna panels located in its respective antenna module without affecting the alignment or performance of antenna panels belonging to other service providers contained in stacked antenna modules co-located on the tower;

The provision of such an antenna mounting system in which the lower connecting surface of an antenna module of the present invention is designed to be affixed directly to either the upper end of a lattice-type or monopole tower or to the upper end of a second antenna module of the present invention;

The provision of such an antenna mounting system in which the upper connecting surface of an antenna module of the present invention is designed to receive either the lower connecting surface of a second antenna module of the present invention or an end cover; and The provision of such an antenna mounting system which is of rugged and economical construction, which is readily installed, has a "clean" visual appearance, and a long service life.

Briefly stated, an antenna module of the present invention is intended for installation on a wireless lattice-type or monopole telecommunications tower at a cellular or PCS transceiver site. The antenna module contains a small-footprint frame adapted for installation on either the top of a tower or another antenna module. The frame has a means for mounting one or more panel antennas, along with any associated equipment and cables. The mounting means includes means for independently adjusting each antenna panel's compass (azimuth) direction and inclination (elevation) relative to the tower and relative to the horizontal so as to permit adjustments in the direction of the azimuth beamwidth direction and the elevantion beamwidth direction thereby to optimize signal transmission and reception. A radio frequency energy transparent cover extends heightwise of the antenna module, surrounding it so as to enclose the antenna panels and to reduce wind resistance.

The small-footprint design of the present invention antenna module places individual dual polarization antenna panels in close proximity, reducing the interference caused by undesired side and back lobe emissions by containing and absorbing the emissions within the antenna module structure. The additional use of commercially available radio frequency energy absorbing material further reduces side and back lobe interference between the dual polarization antenna panels, correspondingly increasing performance.

Further, within the scope of the present invention, two or more antenna modules may be stacked on top of the other in an end-to-end relation so that more than one antenna module may be carried on a single tower.

Objects and features of this invention will be in part apparent and in part pointed out hereinafter.

BRIEF DESCRIPTION OF THE DRAWINGS

The accompanying drawings, together with the description serve to explain the principles of the invention and will make clear its novel features.

Corresponding reference characters indicate corresponding parts throughout the several view of the drawings.

DESCRIPTION OF THE PREFERRED EMBODIMENTS

Figure 1:
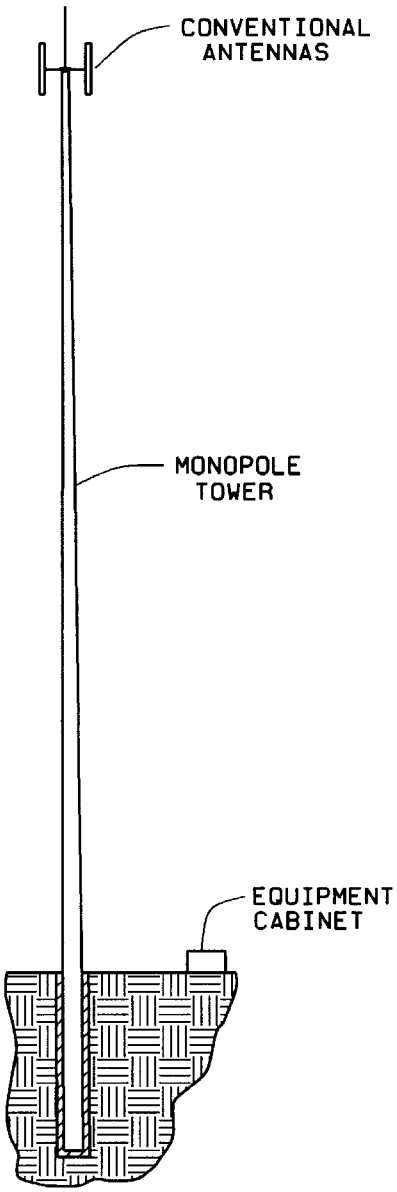
FIG. 1 PRIOR ART
FIG. 1 is an elevation view of a prior art cellular wireless transceiver site having a monopole tower supporting at its top a prior art horizontal antenna assembly framework carrying conventional transmitting and receiving antenna panels employing spatial diversity receive technology.
Figure 2:
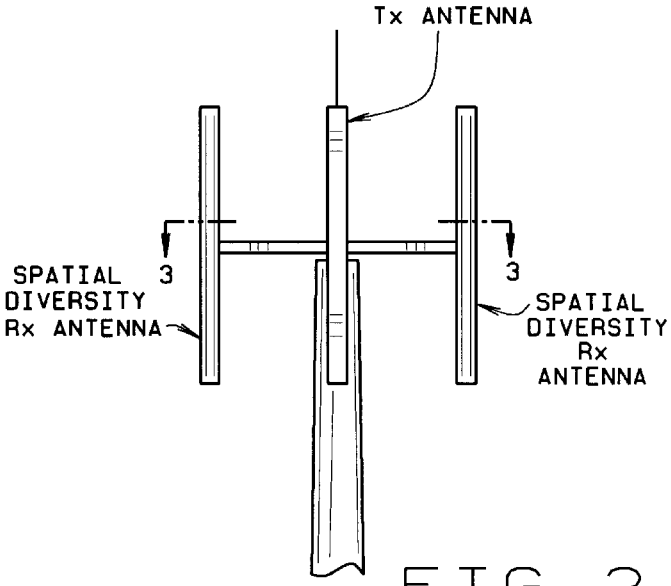
FIG. 2 PRIOR ART
FIG. 2 is an enlarged view of the prior art horizontal antenna assembly framework at the top of the monopole tower shown in FIG. 1, illustrating the individual transmitting and the receiving antenna panels.
Figure 3:
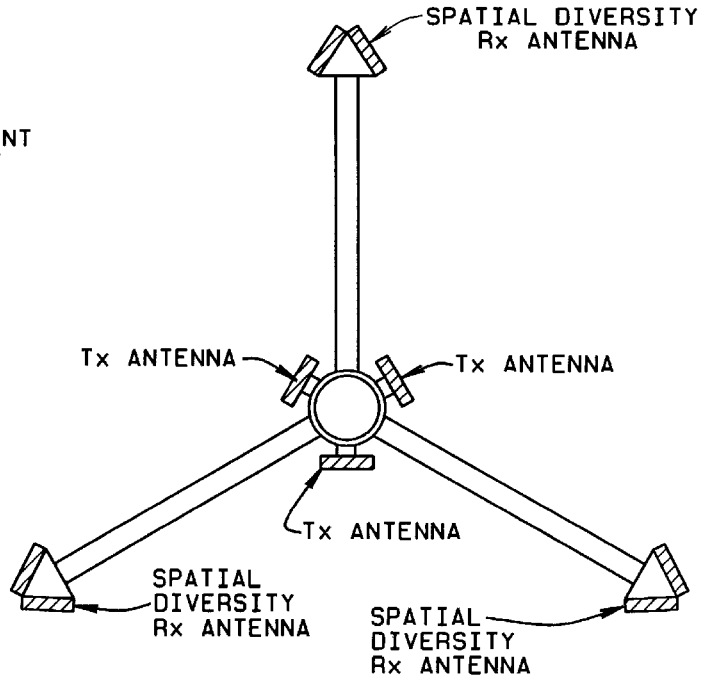
FIG. 3 PRIOR ART
FIG. 3 is a cross section taken along line 3—3 of FIG. 2, showing the placement of the individual transmitting antenna panels, the paired spatial diversity receive antenna panels, and the overall triangular shape of the framework.
Figure 4:
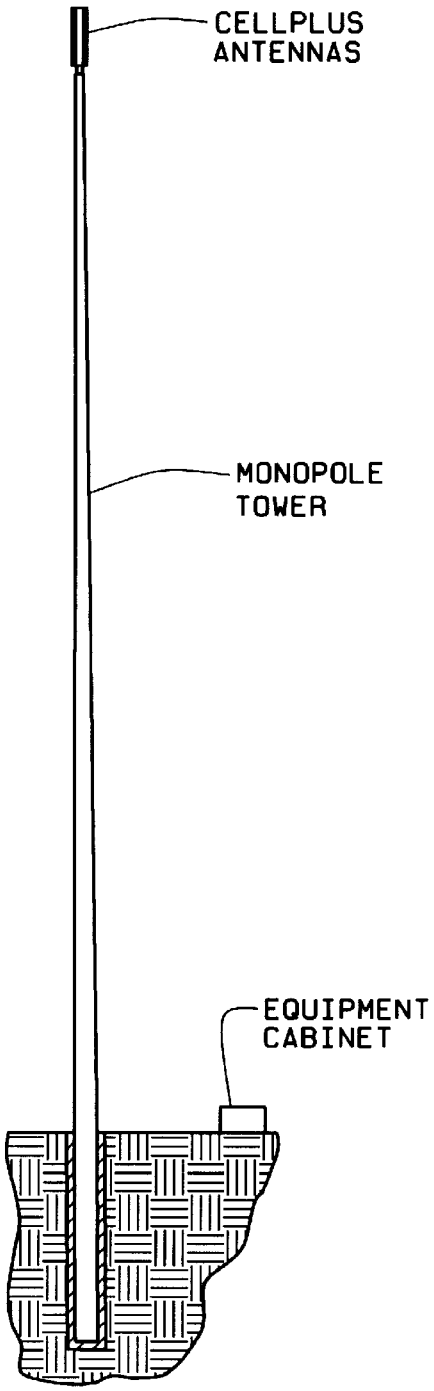
FIG. 4 PRIOR ART
FIG. 4 is a view similar to FIG. 1, but where the prior art horizontal antenna assembly framework designed for spatial diversity receive on the top of the monopole has been replaced by another prior art antenna assembly employing dual polarization antenna panels.
Figure 6:
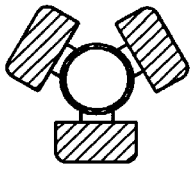
FIG. 6 PRIOR ART
FIG. 6 shows a cross section view taken along line 6—6 of FIG. 5, showing the arrangement of the dual polarization antenna panels around the central axis of the antenna assembly.
Figure 5:
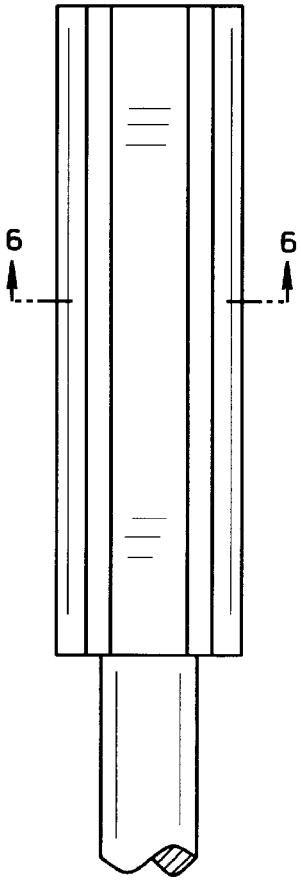
FIG. 5 PRIOR ART
FIG. 5 is an enlarged view of the prior art antenna assembly shown at the top of the monopole tower in FIG. 4, identifying the individual dual polarization antenna panels.
Figure 7:
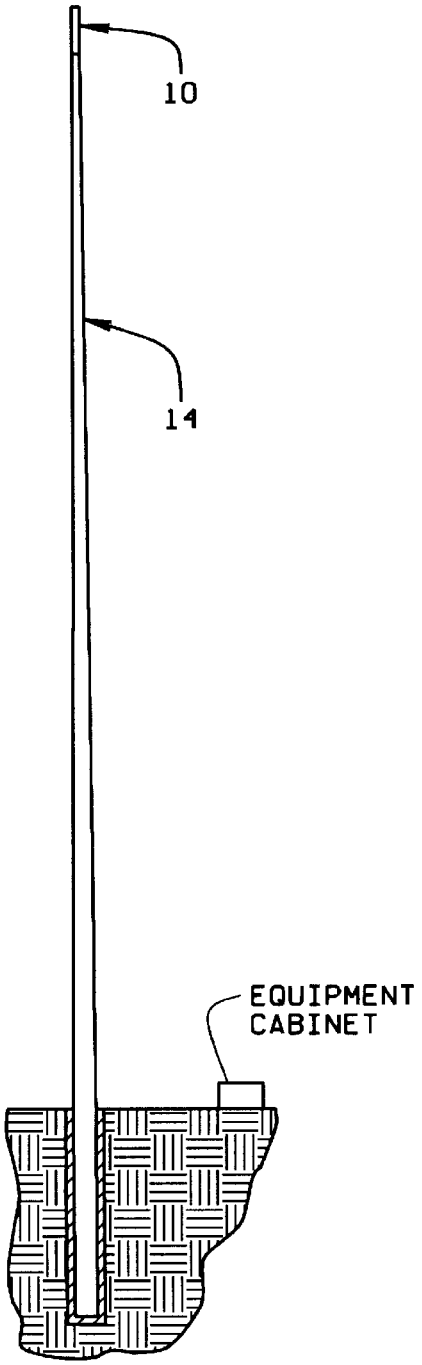
FIG. 7 is a similar view to FIG. 1, but having a single antenna module of the present invention attached to the top of the tower so as to appear as an extension of the monopole tower.
Figure 8:
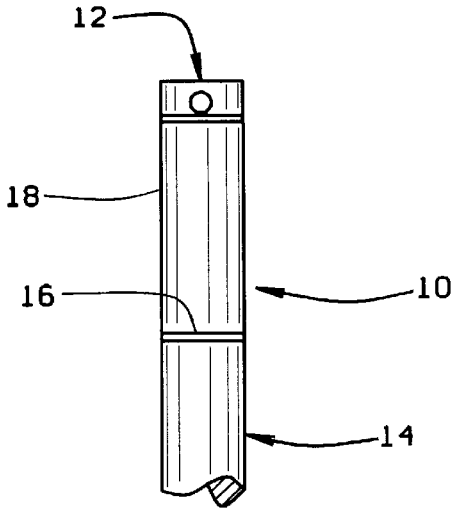
FIG. 8 is an enlarged view of a single antenna module of the present invention shown at the top of the monopole tower in FIG. 7.
Figure 9:
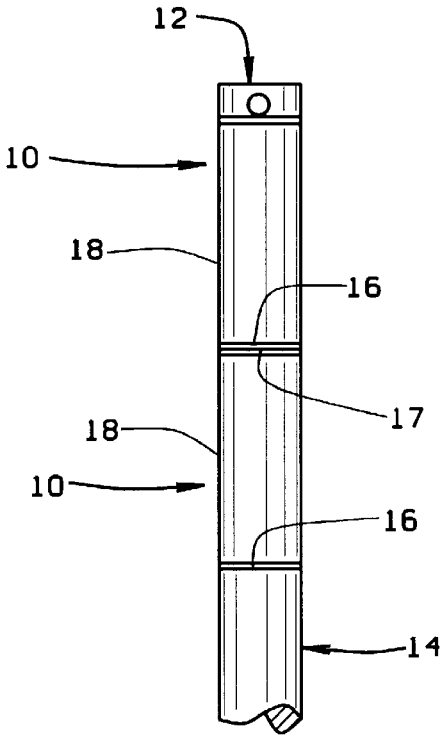
FIG. 9 is a view similar to FIG. 8, but where a second antenna module of the present invention has been affixed to the top of the previous antenna module, forming a stacked or dual antenna array.

Referring to the drawings, and particularly to FIGS. 7–9 inclusive, a single antenna module of the present invention is shown generally at 10. In FIG. 7, a single antenna module 10 is attached to the upper end of standard commercially available monopole tower 14 of the type commonly found at a wireless telecommunications site. The lower end of antenna module 10 is secured to either the upper end of monopole tower 14 (as shown in FIG. 8), or the upper mounting flange 17 of the next lower vertically stacked antenna module 10 by means of a lower mounting flange 16 as shown in FIG. 9. An end cap 12 is secured to the uppermost end of the upper antenna module 10.

Figure 15:
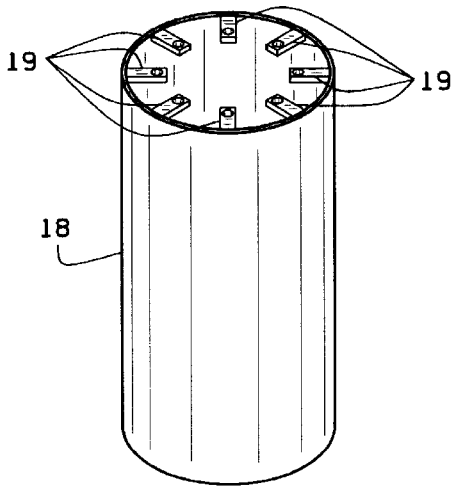
FIG. 15 shows the radio frequency energy transparent cover of the present invention.
Figure 16:
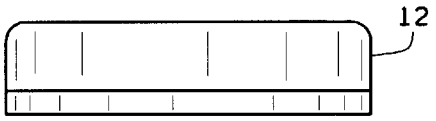
FIG. 16 shows an end cover for the antenna module of the present invention.

Each antenna module 10 is enclosed by a cylindrical cover 18 composed of a commercially available radio frequency energy transparent material, such as fiberglass, shown in FIG. 15. The cylindrical cover 18 is secured to the upper surface of the lower mounting flange 16 and the lower surface of the upper mounting flange 17 by a plurality of cover attachment flanges 19 radiating inward from the upper and lower ends of the cylindrical cover 18. The outer diameter of the cylindrical cover 18 is preferable the same diameter as that of the upper end of the tower on which the antenna module 10 is installed, but may range between 0.5 and 2.5 times that diameter as is necessary to for the cylindrical cover 18 to fully encircle the antenna module 10. The cylindrical cover 18 serves to reduce the wind resistance of the antenna module 10, and significantly improves overall visual appearance. While cover 18 is herein described as being of cylindrical cross-section, it will be appreciated that the cover can be of any desired shape, including an "airfoil" or streamlined shape and that the cover can be mounted for rotation about the vertical centerline of the antenna module (the vertical centerline of the tower) such that the cover may turn into the wind and even further minimize the aerodynamic wind loading on the antenna module.

Referring generally to FIGS. 10–14, the preferred internal structures of the antenna module 10 are shown. The primary support structure is the monopole extender or frame 22, a cylindrical tube constructed of a rigid material such as commercially available structural steel. The monopole extender 22 is open at both ends, and has an inner diameter sufficient to provide space for passage of the minimum number of radio frequency (RF) cables 32, required to service all antenna modules 10 installed in a three unit stacked configuration. One or more cable access openings 38 pass through the sides of the monopole extender 22, allowing RF cables 32 to be connected to installed dual polarization antenna panels 30. In the preferred embodiment of the antenna module 10, cable access openings 38 are positioned near the upper and lower ends of the monopole extender 22, allowing cables short-distance access the upper and lower ends of installed dual polarization antenna panels 30.

Figure 10:
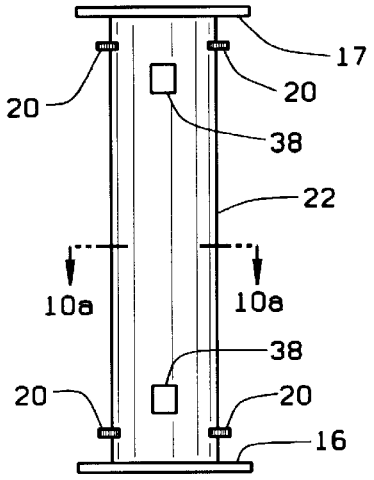
FIG. 10 shows a support structure for the antenna module of the present invention.
Figure 10A:
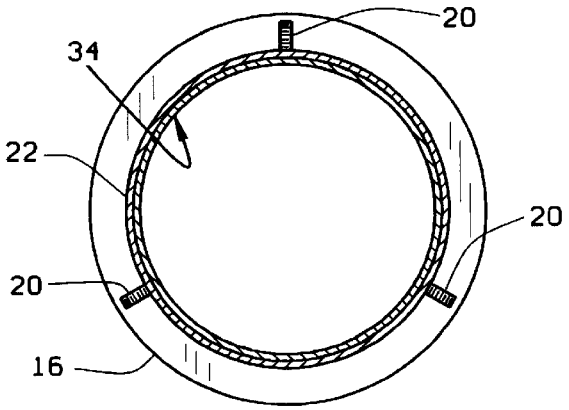
FIG. 10*a* is an enlarged cross section view of a monopole extender similar to that of FIG. 10, taken along line 11—11 of FIG. 10, showing an alternate embodiment of the monopole extender or frame in which the inner surface is lined with commercially available radio frequency energy absorbing material to further reduce undesired back lobe emissions from the dual polarization antenna panels.

The overall height of the monopole extender 22 must exceed the vertical dimensions of the largest commercially available dual polarization antenna panel 30 which is to be installed in that antenna module 10. In an alternate embodiment of the present invention, shown in FIG. 10*a,* commercially available radio frequency energy absorbing material 34 of the type available from Advanced Absorber Products, Inc., Amesbury, Mass. or Emerson & Cumin, Inc., Canton, Mass., is secured to the inner surface of the monopole extender 22, further absorbing any undesired side and back lobe emissions which may emanate from installed dual polarization antenna panels 30. For example, such RF absorbing material may be an elastomeric foam material having graphite or other RF absorbing materials incorporated therein. However, other types of RF absorbing materials well known to those skilled in the art may be used.

Secured to the lower end of the monopole extender 22 is the lower mounting flange 16, composed of a rigid commercially available material, such as structural steel, which can withstand high wind-load conditions. In the preferred embodiment, the lower mounting flange 16 is shaped in the form of a ring flattened along its central axis, and extends outward from the monopole extender 22 to or beyond the minimum outer diameter of the antenna module 10. Of course, those skilled in the art will recognize that the upper end of the tower to which the monopole extender 22 is to be mounted must have suitable mounting means (not shown) for cooperating with lower mounting flange 16 such that the monopole extend 22 may be rigidly bolted or otherwise secured to the upper end of the tower. The minimum outer diameter of the antenna module 10 is determined by size and placement of the largest dual polarization antenna panel 30 which is to be installed in the antenna module 10. Similarly, affixed to the upper end of the monopole extender 22 is the upper mounting flange 17, composed of the same material. In the preferred embodiment of the antenna module 10 the upper mounting flange 17 is shaped identically to the lower mounting flange 16 so as to allow the lower mounting flange 16 of an antenna module 10 to be attached directly to the upper mounting flange 17 of a next lower vertically stacked antenna module 10 as is shown in FIG. 9.

Radially secured to the exterior surface of the monopole extender 22 are a plurality of adjustment bolts 20 designed to support one or more rotation sleeves 24. The exact number and positioning of the adjustment bolts 20 is dependent upon the number and size of commercially available dual polarization antenna panels 30, such as the PHAZAR Planar Antennas produced by Hazeltine Corporation, Greenlawn, N.Y., to be installed in the antenna module 10. Each adjustment bolt 20 is equal in length, and sufficiently long enough to extend through a panel adjustment slot 26 in an installed rotation sleeve 24, but is not sufficiently long enough to contact the cylindrical cover 18. As is shown generally in FIGS. 10–14, the preferred embodiment of the antenna module 10 employs a total of six adjustment bolts 20 arranged into two equal sets. In the preferred embodiment, one set of adjustment bolts 20 is positioned equidistant from each other around the circumference of the monopole extender 22 slightly below the upper mounting flange 17. Correspondingly, in the preferred embodiment, the second set of adjustment bolts 20 is positioned equidistant from each other around the circumference of the monopole extender 22 slightly above the lower mounting flange 16. Again, within the broader scope of this invention, many different antenna panels may be used.

Positioned concentrically around the monopole extender 22 are one or more rotation sleeves 24. Each rotation sleeve 24 is a cylindrical tube whose inner diameter is slightly larger than the outer diameter of the surface of the monopole extender 22. The height of each rotation sleeve 24 is dependent upon the total number of rotation sleeves 24 employed in the antenna module 10, however, the combined height of all rotation sleeves 24 in a given antenna module 10 must be less than the height of the monopole extender 22. The preferred embodiment of the antenna module 10 employs two rotation sleeves 24, equal in size, with height equal to approximately twenty percent of the overall height of the monopole extender 22. Each rotation sleeve 24 contains a plurality of circumferentially aligned panel adjustment slots 26, placed to correspond to the placement and number of adjustment bolts 20 on the monopole extender 22, and of sufficient height to allowing the adjustment bolts 20 to pass through the rotation sleeve 24. Each panel adjustment slot 26 is of sufficient width to allow the rotation sleeve 24 partial freedom to rotate concentrically around the monopole extender 22. It should be obvious to one skilled in the art that installation and tightening of commercial available hardware such a nut and washer combination on the adjustment bolts 20 will retain the rotation sleeves 24 in a fixed position relative to the monopole extender 22 preventing rotation.

Figure 11:
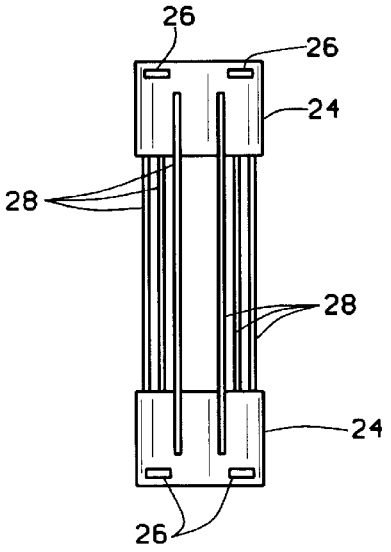
FIG. 11 shows a rotation sleeve, a support structure for the antenna module of the present invention onto which the dual polarization antenna panels are attached.
Figure 12:
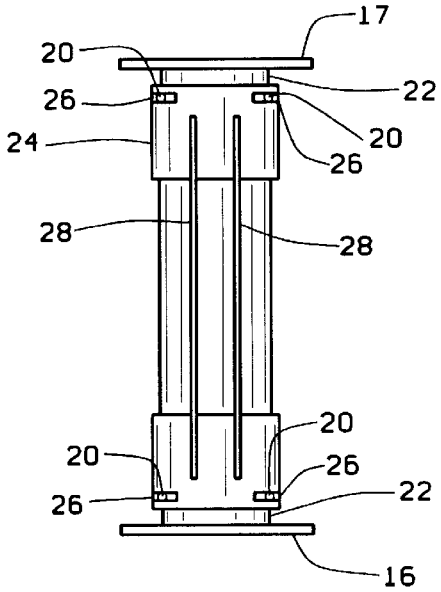
FIG. 12 shows the rotation sleeves of FIG. 11 assembled on the monopole extender of FIG. 10.
Figure 13:
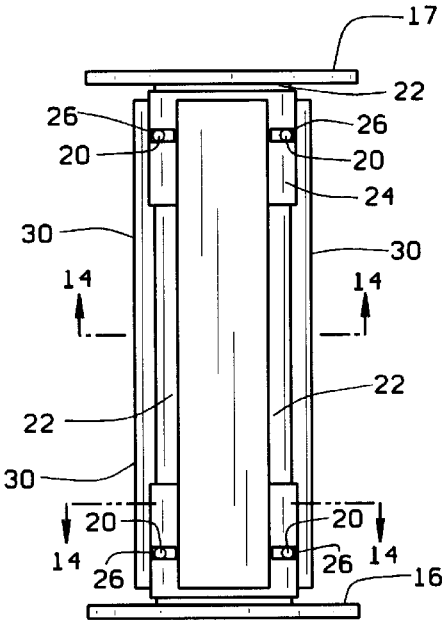
FIG. 13 shows the assembly in FIG. 12 with multiple dual polarization antenna panels attached.
Figure 14:
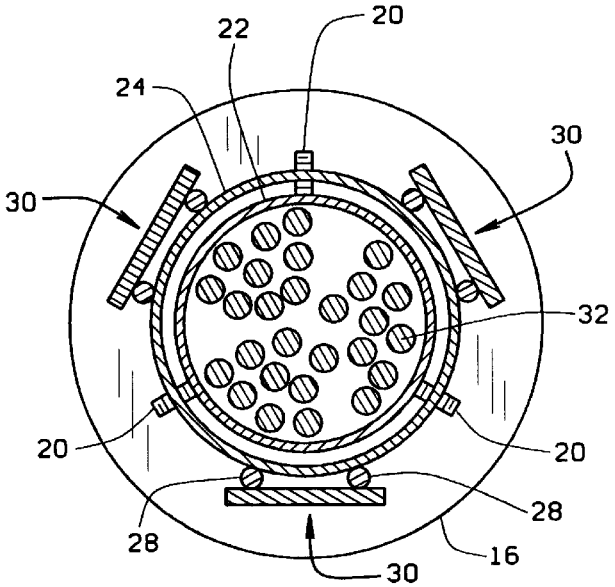
FIG. 14 shows an enlarged cross section view of the antenna assembly shown in FIG. 13, cut along line 13—13.

Secured to the exterior of the rotation sleeve 24 are one or more vertically aligned antenna panel mount bars 28, shown generally in FIG. 11. The size and placement of the antenna panel mount bars 28 is dependent upon the size and number of commercially available dual polarization antenna panels 30 to be installed in the antenna module 10, but the length of the antenna panel mount bars 28 must remain less than the height of the monopole extender 22. In the preferred embodiment of the antenna module 10, three pairs of antenna panel mount bars 28 are secured along their upper and lower ends to the outer surface of a pair of axially aligned rotation sleeves 24, equidistant between the panel adjustment slots 26, forming a rigid substructure as shown in FIG. 11 (a cross section view may be seen in FIG. 14). One or more commercially available dual polarization antenna panels 30 are secured to the antenna panel mount bars 28 by means of commercial mounting hardware (not shown). In the preferred embodiment of the antenna module 10, one dual polarization antenna panel 30 is secured to each pair of antenna panel mount bars 28, as shown generally in FIG. 13 and FIG. 14.

Simultaneous general rotational alignment around the central axis of the tower of all dual polarization antenna panels 30 secured in an individual antenna module 10 may be accomplished by loosening the connecting hardware securing the rotation sleeves 24 to the adjustment bolts 20, rotating the rotation sleeve 24 axially about the monopole extender 22 to the desired position, and then re-tightening the connecting hardware. Similarly, individual dual polarization antenna panels 30 may be optimally aligned for vertical inclination relative to the horizon (elevation) and horizontal angular positioning (i.e., compass heading) relative to other dual polarization antenna panels 30 and the central axis of the tower, or some other predetermined compass direction and elevation, by adjustments made to the length of mounting bolts and the like (not shown) in their respective mounting means without affecting the alignment of the remaining dual polarization antenna panels 30.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An antenna module for installation on a wireless telecommunications tower, said antenna module comprising:

(a) a frame adapted to be installed on the upper end of said tower, substantially coaxial with the longitudinal axis of said tower, said frame having means for coaxially mounting one or more panel antennas in a generally vertical position for the transmission and reception of wireless telecommunication signals, said mounting means including a means for adjusting the alignment of mounted panel antennas for optimal reception and transmission of said signals; and (b) a radio frequency energy transparent cover secured to said frame, said cover extending height-wise of said frame, enclosing said frame, said mounting means, and said panel antennas mounted thereon, so as to reduce wind loading on said antenna module.

2. An antenna module as set forth in claim 1 wherein said adjusting means includes a means for adjusting the angular positioning of said panel antennas relative to said tower about said longitudinal axis of said tower.

3. An antenna module as set forth in claim 2 wherein said adjusting means further includes a means for adjusting the angular positioning of one of said panel antenna relative to another of said panel antennas.

4. An antenna module as set forth in claim 1 where said adjusting means includes a means for adjusting the inclination of said panel antennas relative to the horizon for downtilt or uptilt.

5. An antenna module as set forth in claim 1 wherein said radio frequency energy transparent cover is generally of cylindrical shape, said cover having a cross sectional area ranging between 0.5–2.5 times the cross sectional area of the upper end of said tower on which the antenna module is installed.

6. An antenna module as set forth in claim 5 wherein the cross section of said radio frequency energy transparent cover is approximately the same as the cross section of the upper end of said tower on which the antenna module is installed, such that said antenna module visually appears to be an extension of said tower.

7. An antenna module as set forth in claim 5 wherein the cross section of said radio frequency energy transparent cover is shaped to minimize wind loading on said antenna module.

8. An antenna module as set forth in claim 1 comprising a first antenna module secured to the upper end of said tower and having at least one additional antenna module secured on the top of said first antenna module.

9. An antenna module as set forth in claim 8 having radio-frequency transmitting cables connected to said panel antennas, and wherein said frame of said first antenna module has means therewithin for routing a sufficient number of said cables therethrough so as to service said panel antennas included in said first antenna module and in each of said at least one additional antenna module mounted thereon.

10. An antenna module as set forth in claim 1 wherein radio frequency energy absorbing material is installed internally on said frame so as to improve performance of said panel antennas by absorbing and containing undesired radio frequency energy.

11. An antenna module as set forth in claim 1 wherein said frame includes means on its lower end for attachment of said frame to the upper end of said tower.

12. An antenna module as set forth in claim 11 wherein said frame includes means on its upper end for the attachment of a second antenna module vertically stacked thereon.

13. An antenna module as set forth in claim 1 having three of said antenna panels mounted on said frame and spaced about a vertical axis of said frame at substantially equal angular intervals, said cover having an inner diameter sufficient to enclose said antenna panels such that said antenna panels are in closely spaced proximity to one another within said cover so as to minimize back and side lobe radio-frequency interference emissions.

14. An antenna module for installation on a wireless telecommunications tower, said antenna module comprising:

(a) a frame having a inner member, a means on the lower end of said inner member for installation on the upper end of said tower, and a means on the upper end of said frame for the attachment of a second antenna module vertically stacked thereon;

(b) an outer member carried by said inner member between said upper and lower attachment means, said outer member being generally concentric with respect to said inner member, and having means for mounting one or more panel antennas in a generally vertical position for the transmission and reception of signals, said outer member being adjustably rotatable through at least a limited range of concentric rotation relative to said inner members, thereby allowing said panel antennas secured thereto to be positioned in a desired angular position relative to the vertical axis of said tower, said antenna mounting means including a means for adjusting the alignment of mounted panel antennas for optimal signal reception and transmission; and (c) a radio frequency energy transparent cover extending height-wise of said frame, enclosing said frame, inner and outer members, and panel antennas mounted thereon so as to reduce wind loading on said antenna module.

15. An antenna module as set forth in claim 14 wherein said inner member is structures so as to carry substantially all of the structural load of said second antenna module.

16. An antenna module as set forth in claim 14 wherein said outer member includes a means for adjusting the angular position of one of said panel antennas relative to another of said panel antennas.

17. An antenna module as set forth in claim 14 wherein said outer member includes a means for adjusting the vertical inclination of said panel antennas relative to the horizon.

18. An antenna module as set forth in claim 14 wherein said cylindrical inner member has one or more openings to permit cables within said inner member to be passed through said inner member for connection to said panel antennas secured to said outer member.

19. An antenna module as set forth in claim 14 wherein radio frequency energy absorbing material is secured to the inner surface of said cylindrical inner member to contain and absorb undesired side and back lobe radio energy emissions from said panel antennas.

20. A stacked modular antenna system for a cellular or personal communications system tower for mounting one or more antenna modules in a vertically stacked configuration on the upper end of said tower such that said antenna modules appear to be an extension of said tower, each of said antenna modules comprising:

(a) an internal frame, said frame having an upper and lower mount, said lower mount being adapted to be secured to the upper end of said tower coaxial with the longitudinal axis of said tower if said antenna module is the lowermost of said vertically stacked configuration, and being adapted to be secured to the upper mount of the next lower vertically adjacent antenna module if said antenna module is not the lowermost antenna module in said vertically stacked configuration;

(b) one or more panel antennas carried concentrically by said frame between said upper and lower mounts, each of said panel antennas adapted for the transmission and reception of cellular communications signals;

(c) means for adjusting the position of each of said panel antennas relative to the longitudinal axis of said tower and relative to said other panel antennas carried by said frame so as to align said panel antenna to a predetermined compass direction and elevation; and (d) a cover of radio frequency energy transparent material secured to said frame, said cover enclosing said frame and said panel antennas.

21. A stacked modular antenna system as set forth in claim 20 in which said vertically stacked configuration includes said lowermost antenna module, an uppermost antenna module, and one or more intermediate antenna modules with said lowermost antenna module having its lower mount secured to the upper end of said tower, a vertically adjacent intermediate antenna module having its lower mount secured to the upper mount of the said lowermost antenna module, and with said uppermost antenna module having its lower mount secured to the upper mount of the intermediate antenna module adjacent therebelow.

22. A stacked modular antenna system as set forth in claim 21 wherein radio frequency energy absorbing material is secured to the interior of said internal frame in one or more of said antenna modules in said vertically stacked configuration, said material configured to absorb side and back lobe energy emissions from said panel antennas.

* * * * *